US006807764B1

(12) United States Patent
Phillips

(10) Patent No.: US 6,807,764 B1
(45) Date of Patent: Oct. 26, 2004

(54) CARTRIDGE MAGAZINE FOLLOWER GRIP

(76) Inventor: Larry B. Phillips, 1947 Pitman Downer Rd., Williamstown, NJ (US) 08094

( * ) Notice: Subject to any disclaimer, the term of this patent is extended or adjusted under 35 U.S.C. 154(b) by 0 days.

(21) Appl. No.: 10/685,178

(22) Filed: Oct. 14, 2003

(51) Int. Cl.[7] ..... F41A 9/83
(52) U.S. Cl. ..... 42/87; 42/90
(58) Field of Search ..... 42/90, 87, 88, 42/50

(56) References Cited

U.S. PATENT DOCUMENTS

| | | | | |
|---|---|---|---|---|
| 1,245,499 A | | 11/1917 | Orme | |
| 1,797,951 A | * | 3/1931 | Gaidos | 42/50 |
| 2,137,491 A | | 11/1938 | Huff | |
| 2,514,277 A | | 7/1950 | Donallan | |
| 2,862,324 A | | 12/1958 | Ball | |
| 3,509,655 A | | 5/1970 | Wilhelm | |
| 4,430,821 A | | 2/1984 | Vincent | |
| 4,488,371 A | | 12/1984 | Boyles | |
| 4,829,693 A | | 5/1989 | Holmes | |
| 4,872,279 A | | 10/1989 | Boat | |
| 5,179,245 A | * | 1/1993 | Straka | 89/1.4 |
| 5,355,606 A | * | 10/1994 | Origoni | 42/87 |
| 5,402,594 A | | 4/1995 | Switzer | |
| 5,417,003 A | | 5/1995 | Claveau | |

FOREIGN PATENT DOCUMENTS

| | | | | |
|---|---|---|---|---|
| CH | 293152 | * | 9/1953 | 42/90 |

* cited by examiner

*Primary Examiner*—Stephen M. Johnson
(74) *Attorney, Agent, or Firm*—Marvin C. Gaer

(57) ABSTRACT

A device to facilitate the loading of cartridges into an automatic pistol magazine atop an internal cartridge follower plate which is urged upward by an internal magazine spring. The device comprises a thumb size indented block to which is attached a wire loop. When loading the magazine, the wire loop is hooked around a knob attached to the follower plate, which extends outward through a slot on the magazine wall, and is pulled down, lowering the follower plate, allowing the cartridges to be freely inserted. While loading, the magazine base is inserted into the indentation on the block and the block is held against the magazine base by the force of the spring until loading is completed.

3 Claims, 7 Drawing Sheets

2
6
1
4
8
7
5
3

8
2
1
4
6
A
8
7
3
8

1
3
2
4
5

CARTRIDGE MAGAZINE FOLLOWER GRIP

FIELD OF THE INVENTION

This invention concerns the loading of certain automatic pistol cartridge magazines and discloses an apparatus for gripping the protruding knob, on the cartridge follower in such magazines, in order to depress and hold down the follower against the upward urging of an internal magazine spring to facilitate the insertion of cartridges into the magazine.

BACKGROUND OF THIE INVENTION

Cartridge magazines, which fit into the handles of certain automatic pistols, particularly .22 caliber automatic pistols, are partially flattened tubes open at the upper end to receive cartridges. The inner volume dimensions of such a magazine are just sufficient to allow the insertion and parallel stacking of a single layer of cartridges. The first cartridge inserted into the open end of the magazine, under two partially inward directed magazine lips or flanges, rests upon the upper edge of a slidable flat metal plate called a cartridge follower. The follower is urged or pushed upward, inside the magazine, against the cartridge by a strong, usually helical, spring contained in the closed bottom end of the magazine below the bottom edge of the follower. The other cartridges are loaded into the magazine through this opening also. The spring, pushing upwards against the follower, causes the follower to feed the loaded cartridges, one after another, into alignment with the barrel of the pistol as the cartridges are being fired and the shells ejected. However, this upward spring pressure makes it difficult to insert the cartridges by hand into the magazine during the loading operation. A short knob, the follower knob, attached to the follower, protrudes a short distance outward through an open slit running along the magazine wall. Pushing or pulling down on this follower knob, with one's thumb or fingers, forces the follower downward, away from the open end of the magazine, depressing the spring which facilitates the insertion of the cartridges. However, since this knob is very short, it is hard and even painful to push down on it with one's fingers. This has led to the introduction of various mechanical accessories and devices, to grip the follower knob, in order to ease the depression of the follower and facilitate the insertion of the cartridges into the magazine.

SUMMARY OF THE INVENTION

This invention discloses a cartridge magazine follower grip, that can be detachably connected to the follower knob, in order to facilitate the depression of the follower against the upward directed spring force, which is practical, simple, easy to use and inexpensive to manufacture.

This follower depressor grip comprises a small solid block, slightly larger than a man's thumb, with essentially rectangular faces. Attached to this block, near or at one end by a plug, is a loop of thin, strong wire about two to three inches in length, the length determined by the magazine involved. The block is also slotted or indented, also depending upon the particular type of magazine involved, in order to fit over a protruding base edge or across the base of the magazine. When loading the magazine, the wire loop is hooked around the follower knob, and the loader then pulls the follower downward towards the base of the magazine, via the follower grip attached to the knob, depressing the spring. The block itself is then attached to the base of the magazine by either fitting the slot over the protruding base edge or by fitting the indentation across the base of the magazine. The tension that the spring exerts, via the follower and knob through the wire loop, holds the block fixed in place and the spring depressed while the cartridges are easily inserted into the open end of the magazine. When the loading is complete, the block is detached from the base and the wire loop is unhooked from the follower knob. The cartridges are prevented from being ejected from the magazine by the inwardly bent flanges at the open end of the magazine. The magazine can now be inserted into the pistol which is ready for firing. It is thus an object of this invention to facilitate the loading of cartridges into certain automatic pistol magazines, particularly those in .22 caliber pistols, by providing a device to grip the magazine follower knob, in order to pull down the magazine follower, depressing the spring, thus creating a free space at the open magazine end, in order to allow the easy insertion of cartridges into the magazine.

It is a further object of this invention to provide a means to facilitate the loading of cartridges into an automatic pistol magazine which is practical, easy to use, reliable, portable and inexpensive to manufacture.

These and other objects will be apparent to those skilled in the art.

BRIEF DESCRIPTION OF THE DRAWINGS

The more specific object features and advantages of this invention will be more readily apparent from the following description, wherein reference is made to the accompanying drawings illustrating two preferred embodiments of the invention. In the drawings.

DETAILED DESCRIPTION OF THE DRAWINGS

Figure 1:
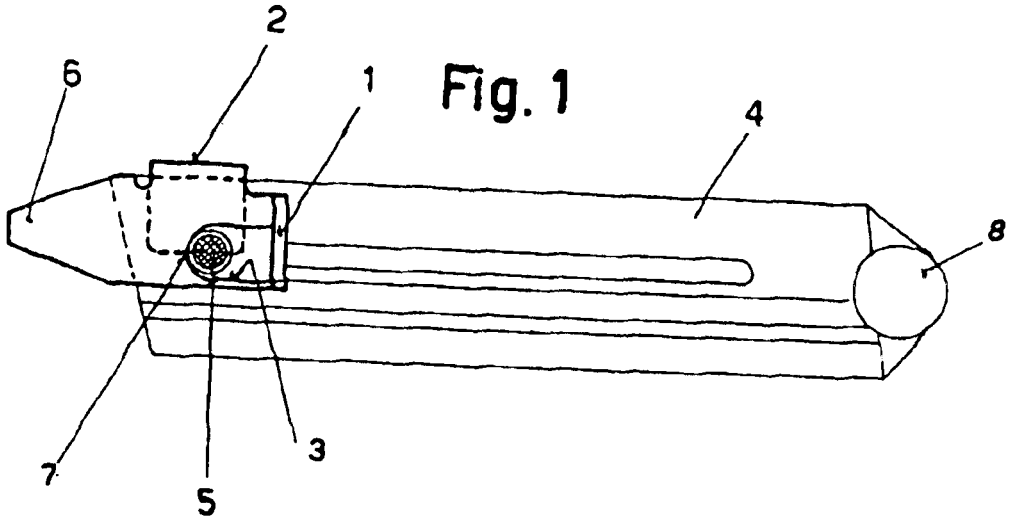
FIG. 1 is a perspective view of a first embodiment of the cartridge magazine follower grip, (henceforth, "follower grip", for brevity), which has a slotted block for attaching to a magazine with a protruding base edge.

Referring now to FIG. 1, a first preferred embodiment of the follower grip, the "slotted block follower grip", is shown, in perspective, comprising a thin looped wire 20, about two to three inches in length, attached to a solid block 22 by a plug 33. The plug 33 is attached to the block 22 by the screw shaft 29, of a hex screw 21, having a hexagonal indentation 36, which is screwed downward into an indentation in the horizontal upper face 23 of the block 22, refer to FIGS. 2, 4, 8, and 9. In particular, FIG. 9 shows that the plug 33 has a tapered face with two small notches 37 and 38 through which the wire loop 20 can pass outward from below the plug indentation in the block 22. The tapering of the plug 33 avoids sharp bends in the wire loop 20 to prevent breaking the wire.

Figure 4:
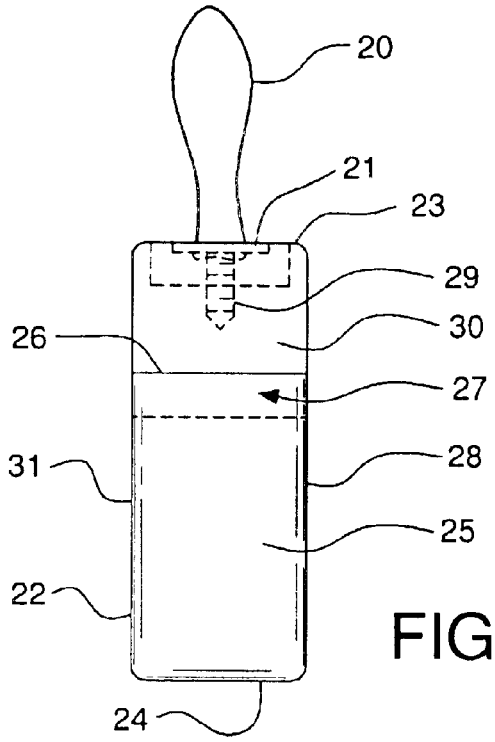
FIG. 4 is a front elevation view of the slotted block follower grip.
Figure 5:
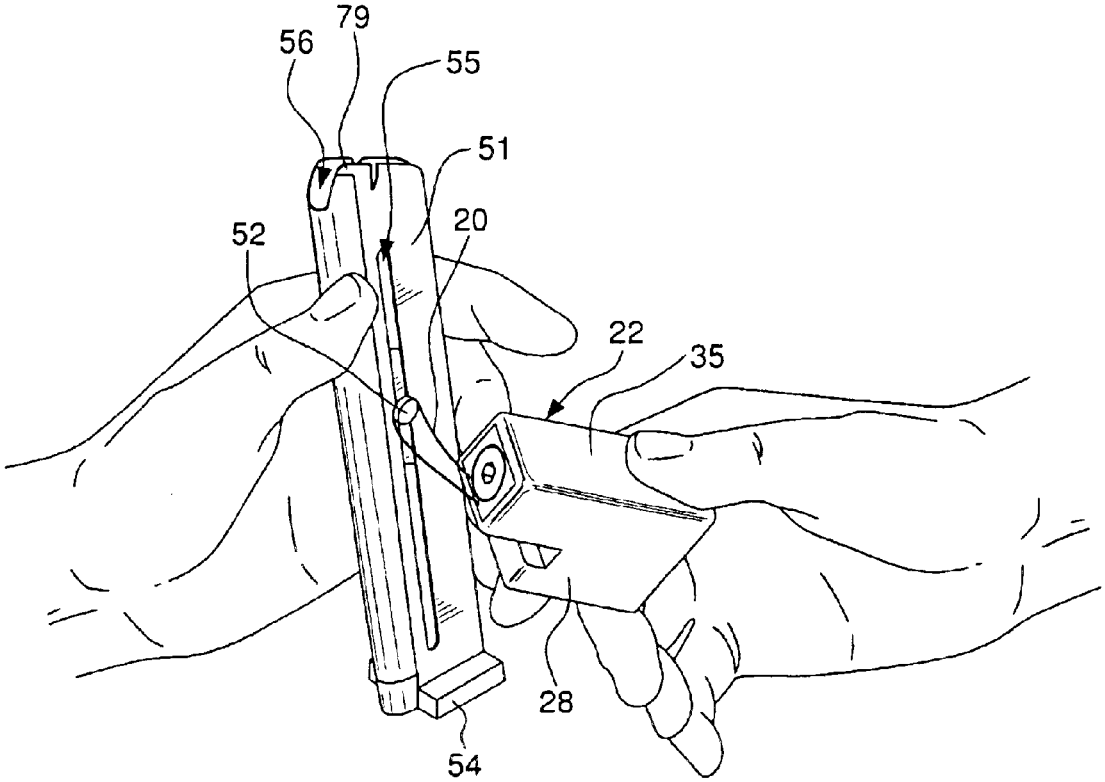
FIG. 5 is a perspective view of one hand holding onto a slotted block follower grip, and pulling down on the follower knob to depress the magazine spring, in a magazine held in the other hand.
Figure 6:
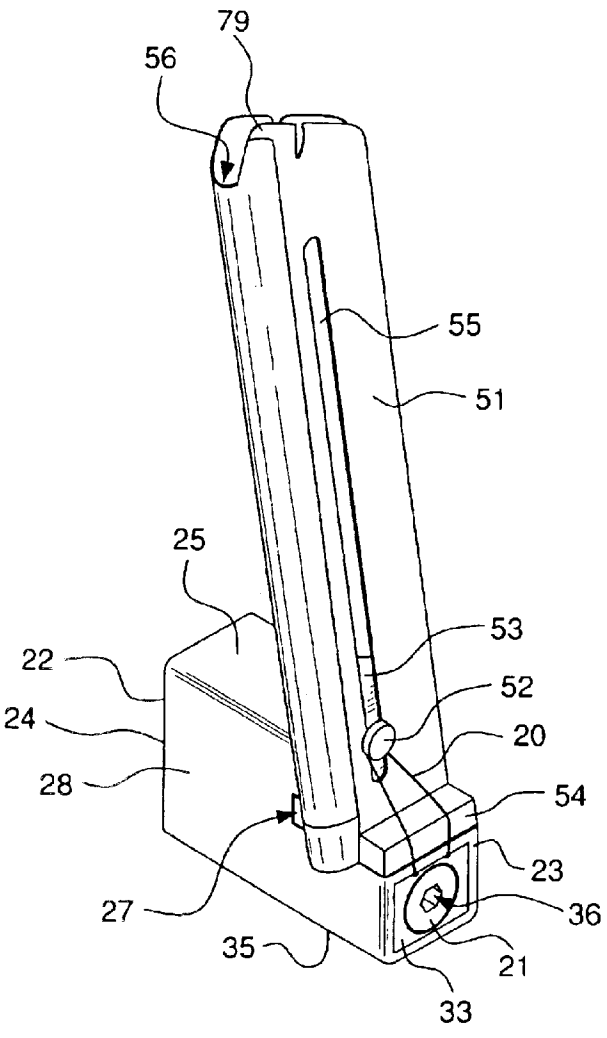
FIG. 6 is a perspective view of a magazine with the follower grip block slot attached to the protruding base edge of the magazine and the spring depressed.

The block 22, as shown in FIGS. 1 and 5, is slightly larger than a man's thumb and has roughly the side profile shape of a block "L" with essentially rectangular faces. This "L" is bounded by the vertical faces 25 and 35, the face 25 being the shorter of the two. The top of the face 25 terminates in a horizontal face 26 which is perpendicular to the inner vertical face 30 of the longer leg bounded by the outer face 35. A short vertical slot 27, along face the 30, extends the face 30 slightly below the horizontal face 26 and prevents the face 26 from meeting the vertical face 30. This slot has a rectangular base which runs horizontally across the block from the vertical face 28 to the vertical face 31, see FIGS. 1, 2, 3 and 4. The vertical length of the face 30, including the vertical depth of the slot 27 is slightly greater than the transverse width of the base 54 of the pistol cartridge magazine 51, as shown in FIGS. 5, 6. 7 and 8. The edge of the base 54, in this type of cartridge magazine, protrudes slightly beyond the lateral wall of the magazine 51. The width of the slot 27 is chosen so that it will fit snugly over the protruding edge of the magazine base 54, see FIGS. 6, 7 and 8.

Figure 2:
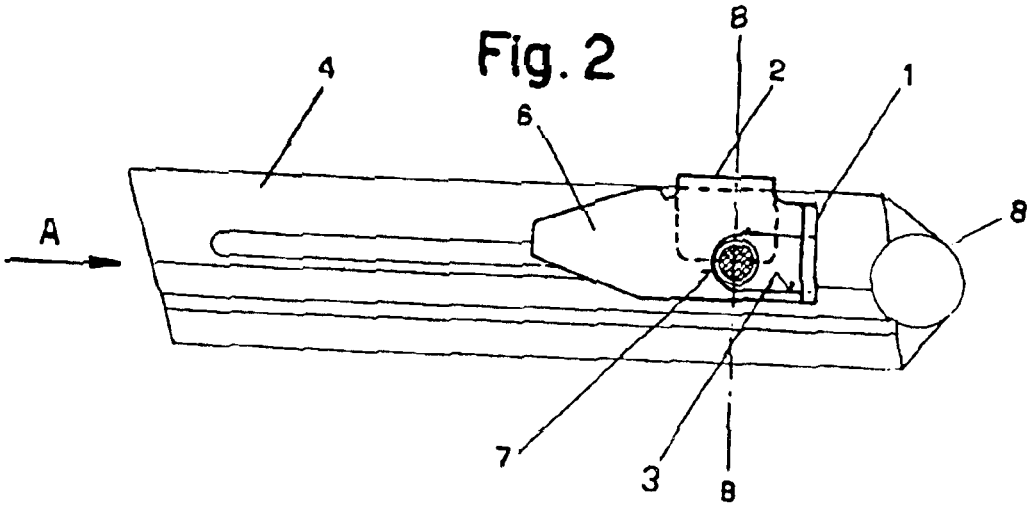
FIG. 2 is a side elevation view of the slotted block follower grip.

In FIG. 2, a side elevation view of the follower grip block 22 is shown along the face 28, with the wire loop 20 attached to the block 22 by the plug 33. The rectangular cross section of the slot 27 is shown clearly here. In this position, the face 24 is the bottom face of the block 22.

Figure 3:
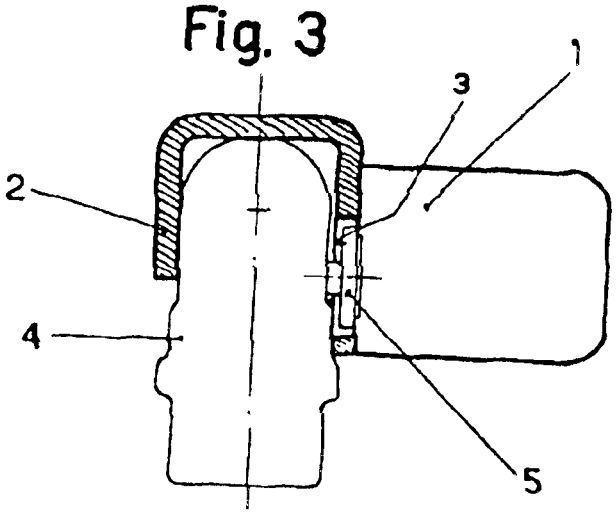
FIG. 3 is top plan view of the slotted block follower grip.

In FIG. 3, an upper plan view of the follower grip of FIG. 1 shows the various elements already described. In FIG. 4, an elevation front view across the face 25 is shown. Both FIGS. 3 and 4 show the slot 27 running across the block intersecting the faces 28 and 31.

Figure 7:
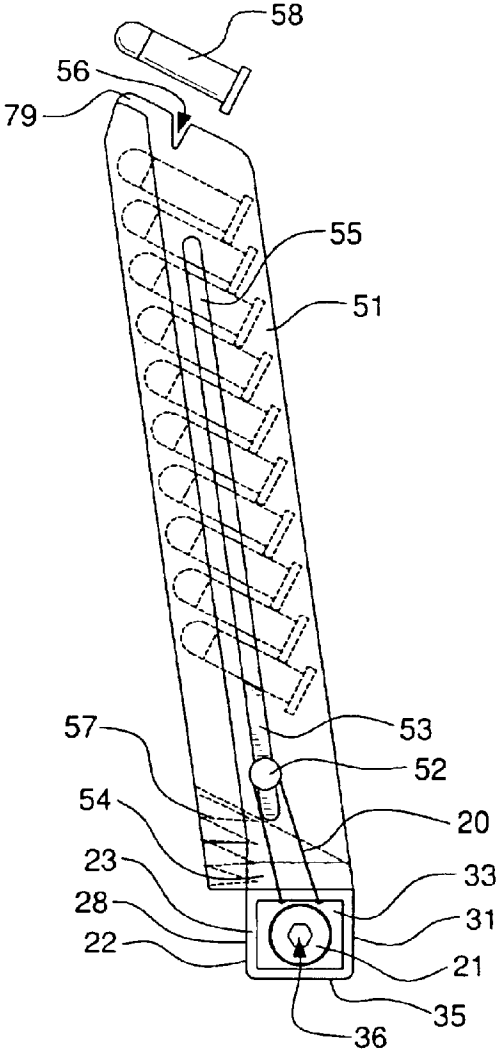
FIG. 7 is a side cutaway elevation view of the configuration of FIG. 6.

Turning now to FIGS. 5, 6, 7 and 8, the follower grip is shown as it is used in loading a cartridge magazine 51. The cartridge magazine 51 is a partially flattened tube having an opening 56 at its top end, through which cartridges 58 are loaded, and is closed at its bottom end where it meets a flat base 54 at a slight angle. This angle allows the cartridge magazine 51 to be inserted into the slanted pistol handle with the cartridge base 54 forming the closed bottom end of the pistol handle grip. As discussed above, in this first embodiment the perimeter of this magazine base 54 extends slightly beyond the walls of the magazine 51. The cartridge magazine 51 is also provided with an open slot 55 which runs almost its entire lateral length. Inside the magazine 51, resting on the base 54, is an upward directed spring 57, and resting on this spring is the cartridge follower 53, which is a flat metal shaft which is urged upward by the spring 57. The cartridge follower 53 is also provided with a small knob 52 which extends a short distance through the slot 55. The bullets or cartridges 58 are loaded into the magazine 51 through its open end 56 onto the top edge of the cartridge follower 53, which in turn is being urged upward by the spring 57, as shown in FIG. 7. The cartridges are prevented from being ejected out of the magazine, before they are fired, by the inwardly bent flanges or lips 79 bounding the open end 56 of the magazine 51. After the cartridges 58 are loaded into the magazine 51, the loaded magazine is inserted into the pistol handle. The spring 57 pushes upward against the cartridge follower 53, which in turn forces the cartridges 58, one after another, into parallel alignment with the barrel of the pistol as they are being fired while also ejecting the empty cartridge shells.

To facilitate the loading of cartridges into the magazine, the follower knob 52 can be pulled or pushed down in order to pull down the cartridge follower 53 against the upward force of the spring 57, thus allowing the cartridges to be freely inserted into the magazine opening 56 without encountering the upward cartridge follower 53 pressure. This knob 52 can be pushed down by the loaders using their fingers, however the upward force of the spring 57 on the cartridge follower 53 makes it difficult and even painful to push down on this short knob 52 with fingers alone. To overcome this problem the follower grip is employed. As shown in FIG. 5, the follower grip block 22 is held in the loader's hand and, with the wire loop 20 attached to the knob 52, the knob 52 is pulled down painlessly, thus lowering the cartridge follower 53 against the upward urging of the spring 57, allowing the easy insertion of the cartridges 58 into the magazine. As shown in FIGS. 5, 6, 7 and 8, with the wire loop 20 attached to the knob 52 and the cartridge follower 53 lowered, the depressor grip block 22 is positioned beneath the magazine base 54 and the outward protruding edge of the magazine base 54 is inserted into the slot 27 on the block 22. The length of the wire loop is such that, when the block 22 is attached to the edge of the base 54 of the magazine 51, the spring 57 pushing upward against the cartridge follower 53, creates sufficient tension in the wire loop 20 to hold the block 22 fixed against the edge of the base 54 of the magazine 51 during the loading operation. When loading is finished, the follower grip is detached from the magazine.

In FIG. 6, a perspective view is shown, from across the side 28 of the block 22, of the edge of the base 54 of the magazine 51 inserted into the slot 27 of the block 22. The wire loop 20 is held taut by being attached to the follower knob 52, extending outward from the magazine slot 55, which is being urged upward by the action of the spring 57 on the cartridge follower 53 as shown in FIG. 7. Similarly, FIG. 7 is a side view of the magazine 51 from the face 23 of the block 22, which is held in place by the taut wire loop 20 attached to follower knob 52.

Figure 8:
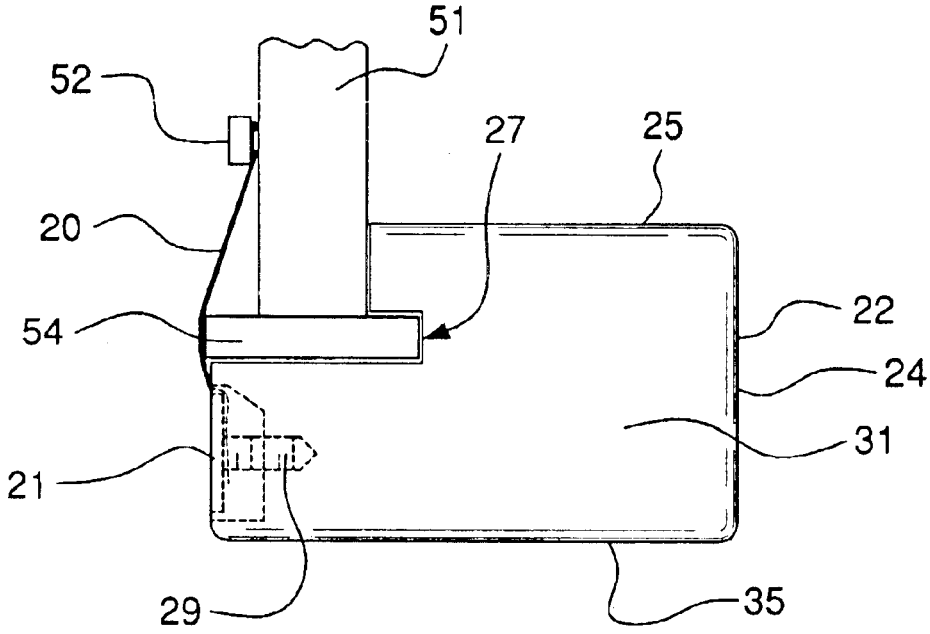
FIG. 8 is a lower side section reverse view of the configuration of FIG. 6.
Figure 9:
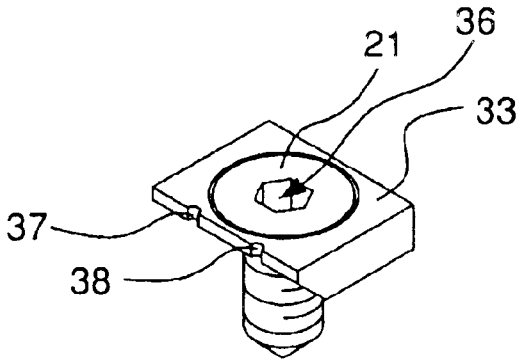
FIG. 9 is a perspective view of the hex screw plug which attaches the wire loop to the follower grip block.

In FIG. 8, another view is shown of the lower portion of the magazine 51 over the face 31 of the block 22. The block 22 is attached to the edge of the magazine base 54, which is inserted into the block slot 27, and is held in place by the tension in the wire loop 20 attached to the magazine follower knob 52. In FIGS. 6, 7 and 8 the block 22 is resting on its face 35.

Figure 10:
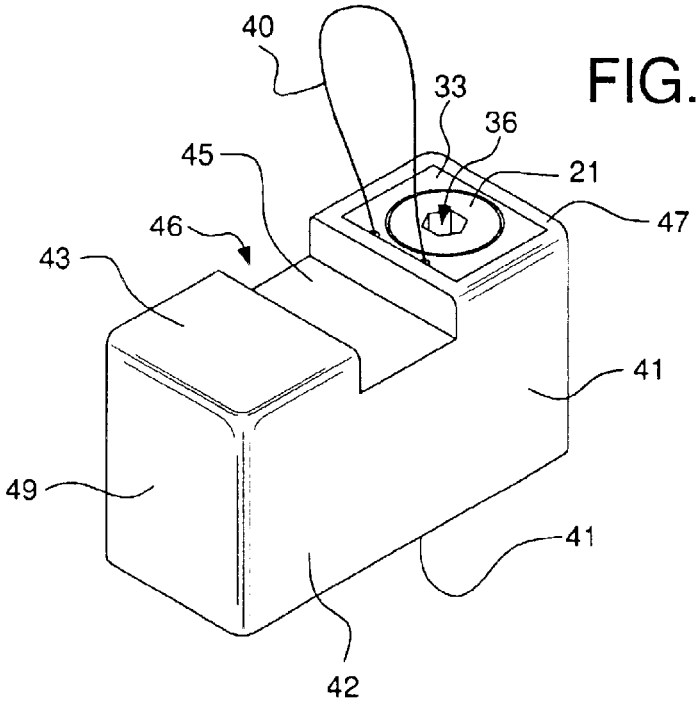
FIG. 10 is a perspective view of a second embodiment of the follower grip having a rectangularly indented block for attaching across a cartridge magazine base.

Referring to FIG. 10, a second preferred embodiment of a follower grip, the "indented block follower grip", is shown in perspective. This follower grip is designed to be used on cartridge magazines with no protruding side edge on their bases. Except for this difference in the magazines, the same problem of holding down the cartridge follower is dealt with in this second embodiment as in the first embodiment.

Figure 11:
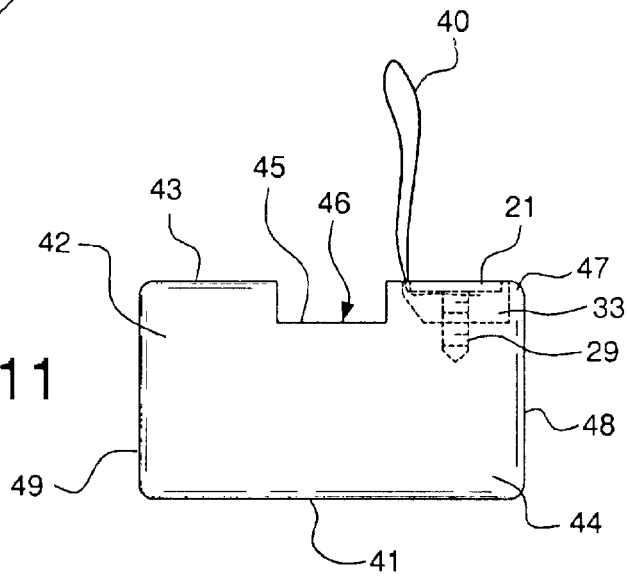
FIG. 11 is a side elevation view of the indented block follower grip.
Figure 16:
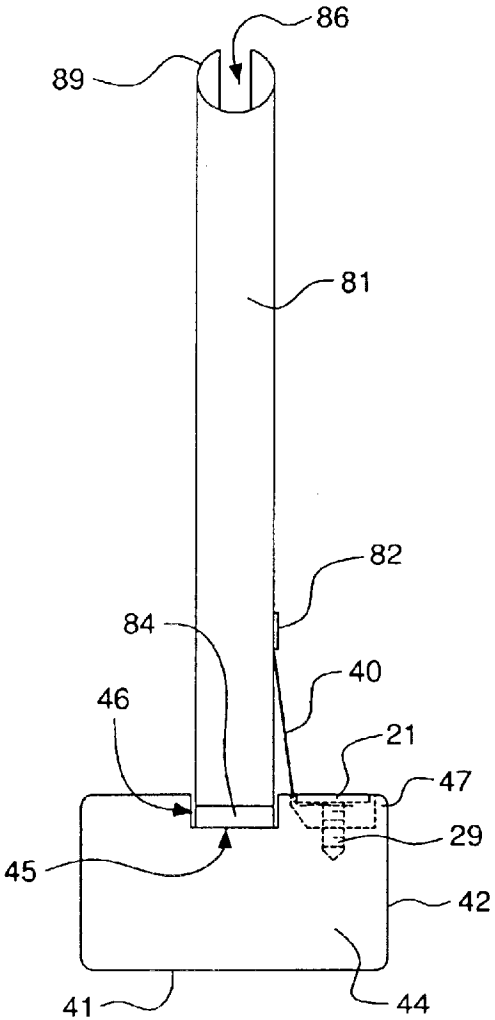
FIG. 16 is an elevation view from the side of the indented block follower grip attached to a magazine.

The second embodiment of the follower grip is a solid block 42, slightly larger than a man's thumb, with essentially rectangular faces, as in the first embodiment. As shown in FIGS. 10 and 11, the top section of this depressor grip is divided into three approximately equal rectangular sections 43, 45 and 47, with the middle section 45 being the floor of a shallow rectangular indentation 45 below the other two sections. The indented face 45 runs across the block 42, from the lateral face 44 to the lateral face 59, see also FIGS. 12 and 13. The outer section 47 is also indented to accommodate the threaded shaft 29, of the hex screw 21, which fastens the plug 33 to the block 42. This plug 33 is described in the first embodiment and is also shown in FIG. 9. This plug is provided for attaching a wire loop 40 to the section 47, as in the first embodiment, see also FIGS. 11, 12, 13, 15 and 16, where FIGS. 11, 13 and 16 show cutaway views of the plug 33 connection. The wire loop 40 is between two and three inches in length.

Figure 12:
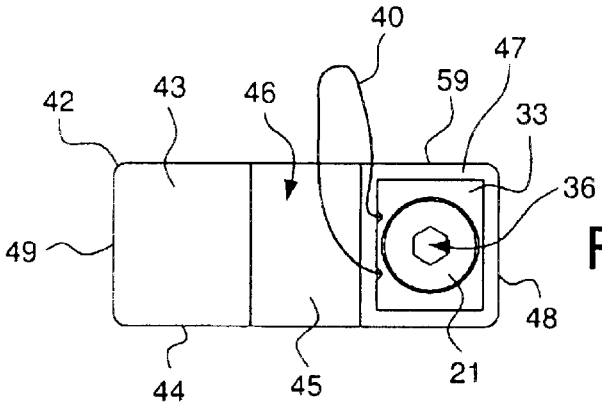
FIG. 12 is a top plan view of the indented block follower grip.
Figure 13:
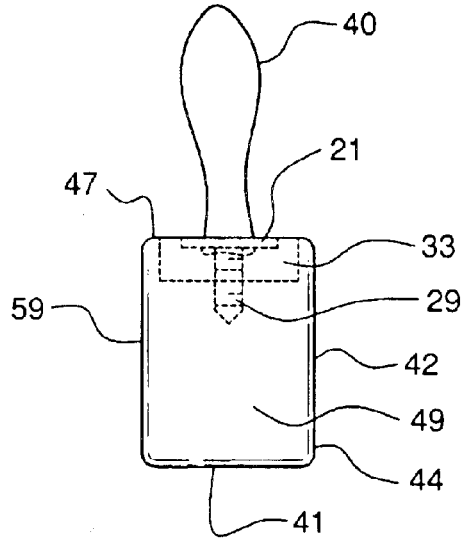
FIG. 13 is a front elevation view of the indented block follower grip.

Different views of the follower plug are presented in FIG. 11, which is a side elevation view along the face 44; in FIG. 12, a top plan view; and a front elevation view along the face 49 in FIG. 13. The block rests on the face 41 in these figures.

Figure 14:
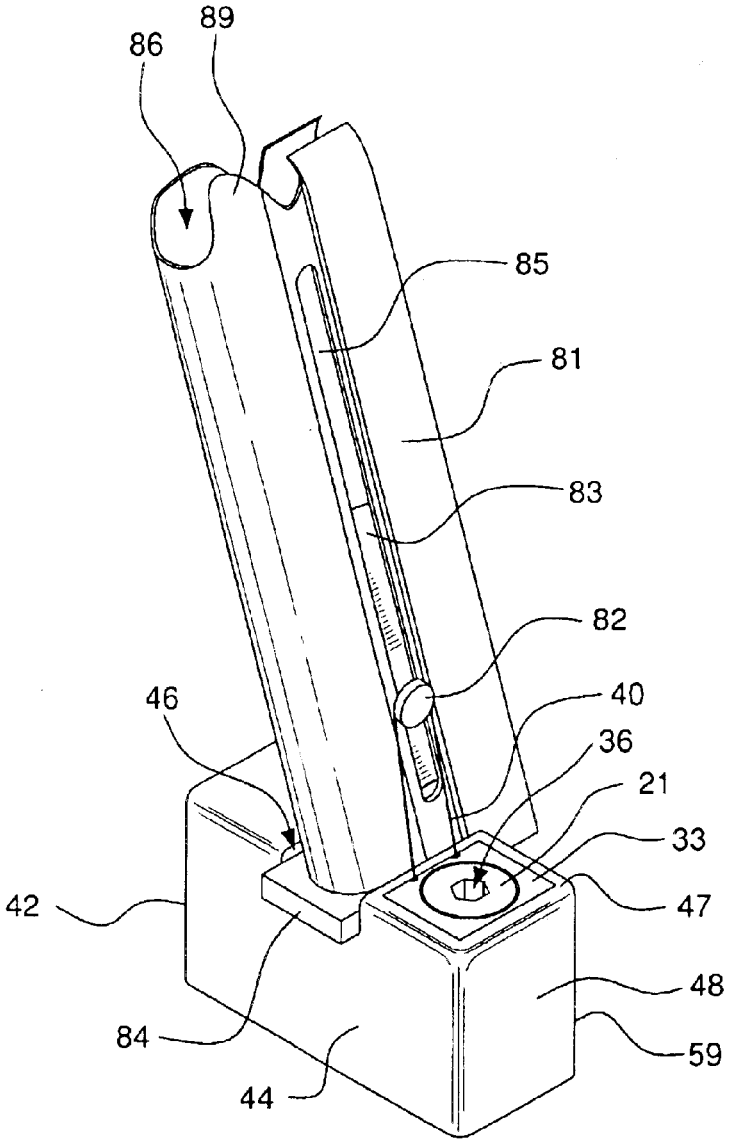
FIG. 14 is a perspective view of a magazine with the base of the magazine attached to the indented block follower grip across the rectangular indentation on the follower grip block.
Figure 15:
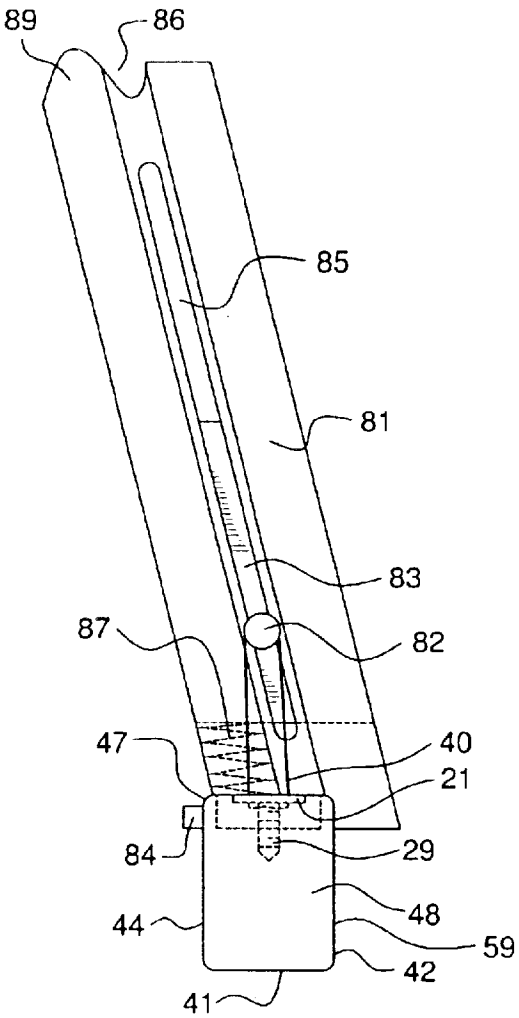
FIG. 15 is a cutaway elevation view from the front of the indented block follower grip with the base of the magazine inserted into the indentation on the follower grip block.

In FIGS. 14, 15 and 16, this follower grip is shown holding down a cartridge follower 83, against the upward pressure of the magazine spring 87 in a cartridge magazine 81, by attaching the wire loop 40 to the follower knob 82, which extends outward through the magazine slot 85, and pulling the knob 82 down. Since the edge of the magazine base 84 does not protrude beyond the lateral sides of the magazine, the base 84 is seated transversely in the indentation 46, against the middle section 45 of the top surface of the block 42, when the block is placed under and across the base of the magazine 81. The tension produced in the wire loop 40 by the upward urging of the spring 87, pushing against the cartridge follower 83, holds the follower grip block 42 fixed across the magazine base 84. The cartridges can then be freely inserted into the open end 86 of the magazine 81 across the flanges or lips 89. A full cutaway side elevation view of this fixed configuration, across the face 48 of the block 42, is shown in FIG. 15. In FIG. 14, a perspective view of this fixed configuration of FIG. 15 is shown with the base 84 of the magazine 81 inserted in the indentation 46. The wire loop 40 is hooked around the follower knob 82 and is held taut by the spring 87 urging the cartridge follower 83 upward. In FIG. 16, this configuration is viewed across the face 44 of the follower grip block 42. When the loading operation is completed, the follower grip is detached from the magazine.

Commonly used .22 caliber pistol cartridge magazines may differ slightly in size, therefore these follower grips may vary in the dimensions of their features in order to fit these different models.

The solid follower grip blocks may be constructed of a hard, strong plastic, ceramic, metal or composite material. The wire loops should be made of a plain or plastic coated strong narrow gauge steel wire similar to a strong fishing line. It is expected that the wire loops will be replaced from time to time. Beside the wire plug, as shown in FIG. 9, there are also other means or methods to attach the wire loop to the block including slots and channels through the block.

Although, this invention and description is directed primarily towards loading .22 caliber automatic pistol magazines, this invention could also be applied, with appropriate dimensional adjustments, to facilitate the loading of other caliber pistol magazines with physical features similar to the magazines described herein.

It will be understood that the above description of the present invention is susceptible to various modifications, changes and adaptations without departing from the spirit and scope of the present invention, and the same are to be comprehended within the meanings and range of the appended claims.

I claim:

1. A pistol magazine cartridge follower grip, to facilitate the loading of cartridges into the open end of a pistol magazine against a magazine spring urged cartridge follower, said grip comprising a solid block, equipped with a wire attaching means, to which is attached a strong narrow gauge wire loop, said wire loop to detachably engage an outward extending knob on said cartridge follower, in order to facilitate pulling down said cartridge follower against the upward urging of said cartridge magazine spring, said block further provided with an indented notch, said block, notch and wire loop so configured and dimensioned that when said wire loop is engaging and pulling down said follower knob, said block notch can be attached to the base of said pistol magazine so that the tension in said wire loop, transmitted from said spring through said cartridge follower, holds said cartridge follower grip fixed to said pistol magazine during said loading operation.

2. The pistol magazine cartridge follower grip of claim 1, for attachment to said pistol magazine wherein said pistol magazine has a base with an outwardly protruding edge, and wherein said solid block resembles a three dimensional block "L" having two upward directed arms of unequal length, each of said arms having an essentially flat horizontal upper surface, wherein said upper surface of said longer arm is equipped with said wire attaching means and with said wire loop attached to said solid block by said wire attaching means on said upper surface of said longer arm of said solid block "L" and wherein said indented block notch is a narrow shallow slot forming a space between said arms of said solid block "L", said slot dimensioned to fit snugly over said outwardly protruding base edge, on the side of said magazine opposite to the side where said wire loop engages said follower knob, to firmly attach said solid block to said magazine, in order to hold down said cartridge follower, via said wire loop attached to said follower knob, when said cartridge follower has been pulled down against the upward urging of said pistol magazine spring.

3. The pistol magazine cartridge follower grip of claim 1, for attachment to said pistol magazine, wherein said pistol magazine has a base which has no outward protruding side edge, wherein said solid block resembles a three dimensional block "U", having two upward directed arms of essentially equal length, each of said arms having an essentially flat horizontal upper surface, wherein said upper surface of one of said arms is equipped with said wire attaching means and with said wire loop attached to said solid block "U" by said wire attaching means on said upper surface of said arm of said solid block "U", and wherein said indented notch is the indentation between said two upward directed arms of said solid block "U" and forms a shallow rectangular depression with vertical walls, dimensioned to fit snugly under and transversely across said pistol magazine base, in order to hold said solid block firmly against said base of said pistol magazine, when said cartridge follower grip is pulling down said cartridge follower, via said wire loop attached to said follower knob, against the upward urging of said magazine spring.

* * * * *